US008516629B2

(12) United States Patent
Victor

(10) Patent No.: US 8,516,629 B2
(45) Date of Patent: Aug. 27, 2013

(54) PORTABLE, PERSONAL LIFTING DEVICE

(76) Inventor: Robert J. Victor, Sunnyside, NY (US)

( * ) Notice: Subject to any disclaimer, the term of this patent is extended or adjusted under 35 U.S.C. 154(b) by 26 days.

(21) Appl. No.: 13/201,883

(22) PCT Filed: Feb. 19, 2010

(86) PCT No.: PCT/US2010/024696

§ 371 (c)(1),
(2), (4) Date: Aug. 17, 2011

(87) PCT Pub. No.: WO2010/096636

PCT Pub. Date: Aug. 26, 2010

(65) Prior Publication Data

US 2011/0296608 A1 Dec. 8, 2011

Related U.S. Application Data

(60) Provisional application No. 61/154,147, filed on Feb. 20, 2009.

(51) Int. Cl.
*A61G 7/10* (2006.01)

(52) U.S. Cl.
USPC ..... 5/83.1; 5/81.1 R

(58) Field of Classification Search
USPC ..... 5/83.1, 81.1 R, 662
See application file for complete search history.

(56) References Cited

U.S. PATENT DOCUMENTS

| | | | | |
|---|---|---|---|---|
| 3,981,484 | A | 9/1976 | James | |
| 5,090,072 | A | 2/1992 | Gray | |
| 6,941,595 | B1 | 9/2005 | Michael | |
| 7,984,524 | B1 * | 7/2011 | Haessly | 5/662 |
| 8,166,588 | B1 * | 5/2012 | Haessly | 5/662 |
| 8,171,587 | B1 * | 5/2012 | Haessly | 5/662 |
| 2007/0011803 | A1 | 1/2007 | Ogrodnick | |
| 2011/0296608 | A1 * | 12/2011 | Victor | 5/83.1 |

* cited by examiner

*Primary Examiner* — Robert G Santos
(74) *Attorney, Agent, or Firm* — Peter J. Rashid

(57) ABSTRACT

A portable, personal lifting device (10, 100) includes a central member (12), a seat (14) attached to the central member (12) in such a way that the seat is capable of translating linearly along the central member (12), an actuator (16) for causing translation between the seat (14) and the central member (12), and a support member (24) to stabilize the central member (12). The central member (12) is positioned between a user's legs in such a way that the user straddles during operation of the device (10, 100), thereby providing an inexpensive, light-weight lifting device that can be used in very close quarters.

7 Claims, 6 Drawing Sheets

*Fig. 7*
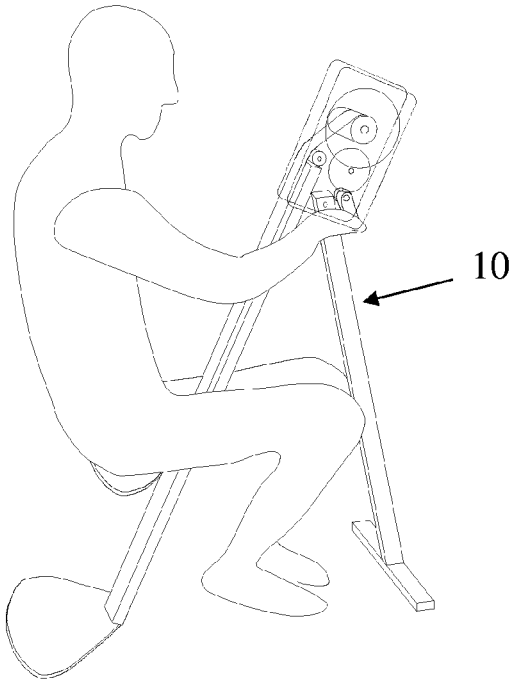
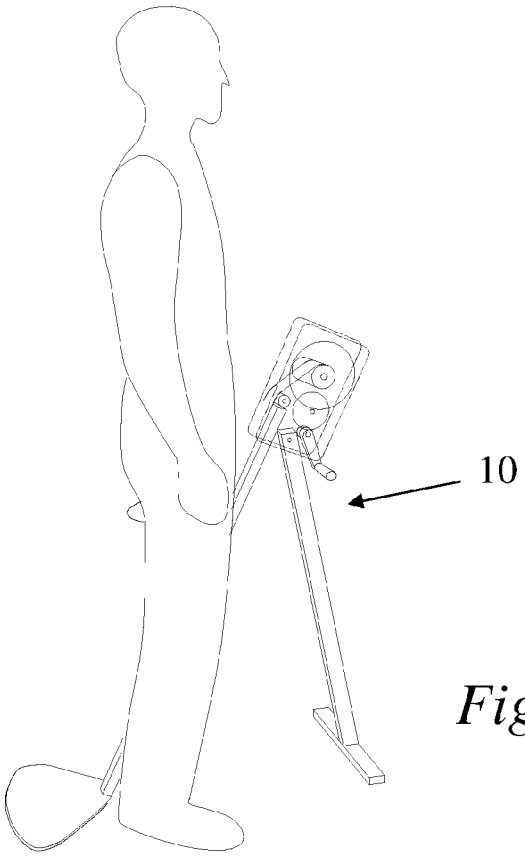
*Fig. 8*

PORTABLE, PERSONAL LIFTING DEVICE

BACKGROUND OF THE INVENTION

There exist a considerable number of people who have the ability to walk, but who lack the leg-strength to raise themselves from the floor to a standing position in case they fall. Such people often have the ability to move about while on the floor, but find it difficult or impossible to rise to their feet. A person in such a situation will frequently be forced to remain on the floor until they can summon assistance. Furthermore, once a care-taker has arrived, the care-taker will frequently find it extremely difficult to assist the fallen person to their feet, and often put themselves at risk of injury during the attempt.

SUMMARY OF THE INVENTION

The inventor has recognized that multiple devices exist for raising a disabled person from the floor to a standing position, and from a seated position to a standing position. However, these devices are, without exception, large and cumbersome, difficult to move and to store, and often too costly for the home user to acquire. Furthermore, the size and weight of these devices typically limits their use to large, unobstructed spaces, despite the fact many at-home falls occur in tight quarters such as bathrooms, tubs, inaccessible basements, and the like.

In addition, the inventor has recognized that many people who are otherwise fully independent and mobile are often compelled to move from their home to an assisted-living facility, simply in anticipation of the possibility that they may fall at a time when a care-taker is unavailable, or unable, to assist them.

The inventor has solved these problems by positioning the lifting device between the user's legs in such a way that the user straddles the device, rather than the device straddling the user as in conventional lifting devices.

Because the lifting device of the invention does not extend significantly beyond the bounds of the user's body, the device may be used in very close quarters, such as within a bathtub, or a cluttered basement. Furthermore, the minimal structure required by the lifting device of the invention enables the device to be extremely lightweight, portable, and inexpensive to manufacture.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

FIG. 7 is a perspective view of the portable, personal lifting device of FIG. 1 in which the user is being lifted off the floor by the device; and FIG. 8 is a perspective view of the portable, personal lifting device of FIG. 1 in which the user has been lifted from the floor to a standing position using the device.

DETAILED DESCRIPTION OF THE INVENTION

Figure 1:
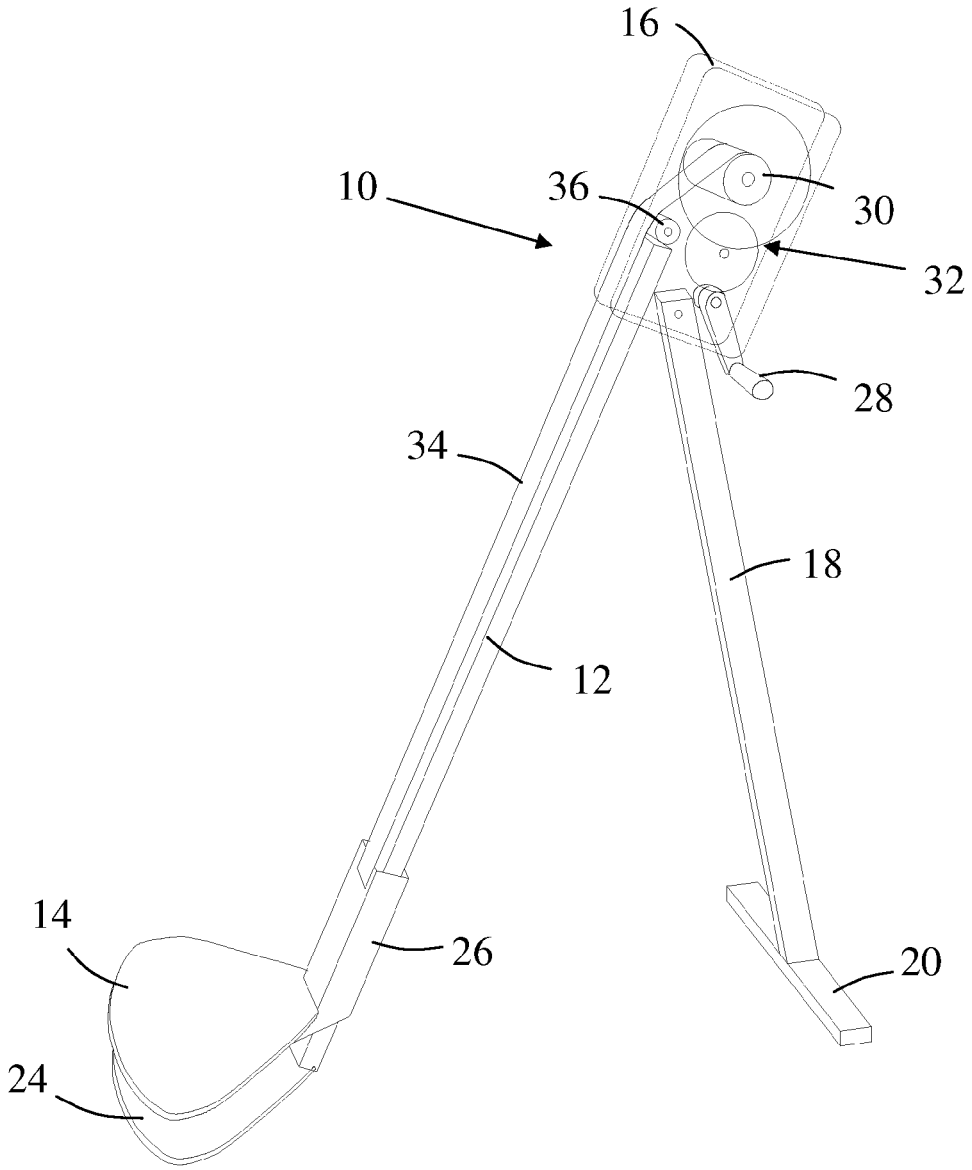
FIG. 1 is a perspective view of a portable, personal lifting device according to an embodiment.
Figure 2:
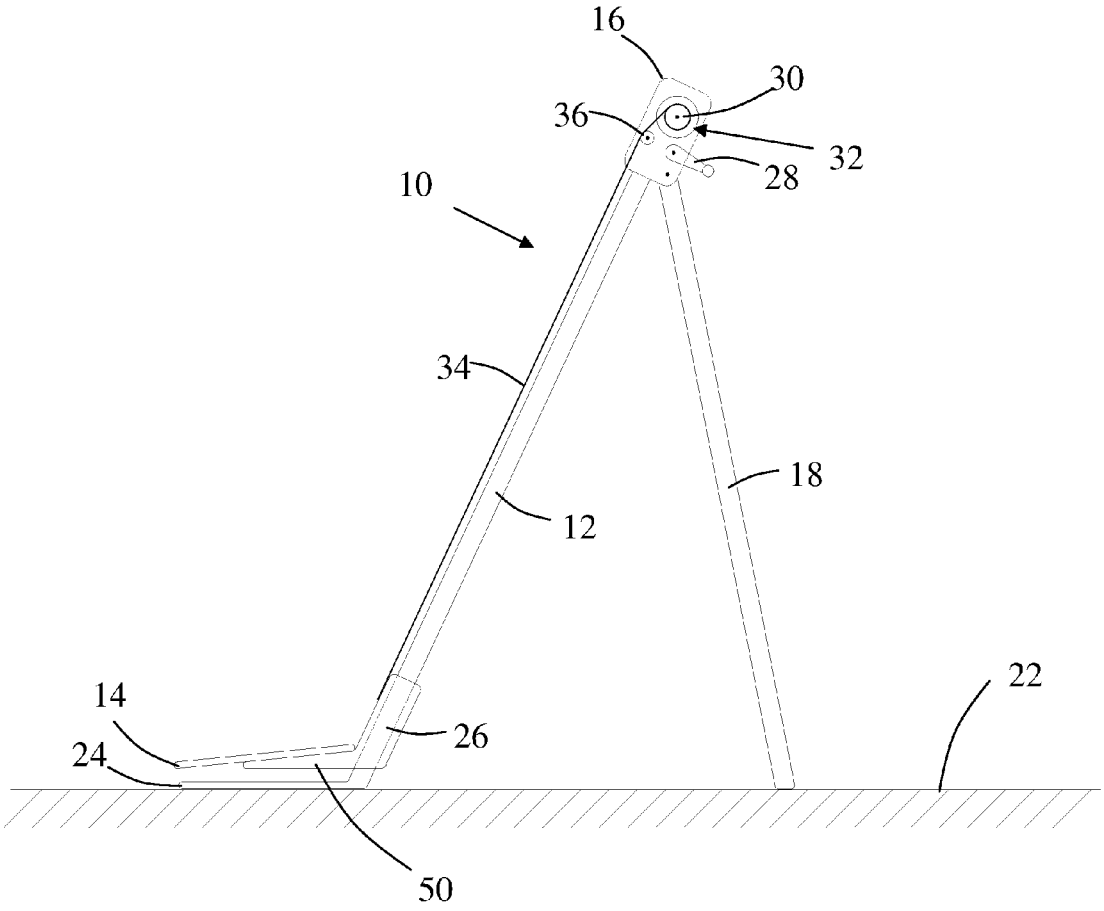
FIG. 2 is a side view of the portable, personal lifting device of FIG. 1.

Referring now to FIGS. 1 and 2, a personal, portable lifting device is shown generally at 10. The device 10 includes a central member 12, a seat 14 attached to the central member 12 in such a way that the seat 14 can translate linearly along the central member 12, and an actuator 16 to cause such translation between the central member 12 and the seat 14.

In the preferred embodiment of the invention, central member 12 is supported by a strut 18, which is hingedly connected to the central member 12 to allow the strut 18 to fold against central member 12 for easy storage of the device 10, if desired. A cross member 20 may be attached to, or integrally formed with, the strut 18 to provide additional stability to prevent the device 10 from tipping from side-to-side. The strut 18 allows the central member 12 to be angled with respect to the floor 22 in such a way as to provide stability and prevent the device 10 from tipping back and forth. The angled central member 12 also provides a more energy efficient position for the user, as described below. Additionally, a support member 24 may be affixed to, or integrally formed with, the central member 12 to provide additional support to prevent the device 10 from tipping backward (toward the user) during use of the device 10.

Seat 14 is affixed to an intermediate sliding member 26, which is separate and distinct from central member 12. The intermediate sliding member 26 may contain pads or rollers (not shown) made of a low-friction material of a type well-known in the art to reduce the friction between the sliding member 26 and the central member 12.

Actuator 16 includes one or more cranks 28 that are coupled to a drum 30 through a gear-reduction drive train 32 of a type well-known in the art. As is known in the art, the amount of gear reduction can be selectively adjusted to provide the desired amount of lifting force as a function of the number of revolutions of the cranks 28. A cable or strap 34 made of wear-resistant material, such as steel, nylon, and the like, is arranged around the drum 30, and attached to the intermediate sliding member 26. When the cranks 28 are turned by the user, the drum 30 rotates and draws upon the strap 34, thereby causing the seat 14 (and the intermediate sliding member 26) to translate linearly along the central member 12. Specifically, the actuator 16 causes the seat 14 to ascend and move toward the top of the central member 12 when the cranks 28 are turned by the user in one direction, and to descend and move toward the bottom of the central member 12 when the cranks 28 are turned by the user in the opposite direction. Thus, the seat 14 can reciprocate up and down along the central member 12 depending on the direction of rotation of the cranks 28.

Because the outer diameter of the drum 30 will increase and decrease as the strap 34 is wound and unwound, it may be preferable to pass the strap 34 over an idler roller 36 located proximate the drum 30 to ensure a constant clearance between the strap 34 and the central member 12.

It will be appreciated that the location of the cranks 28 at the top of the central member 12 places them at a convenient height for a care-taker to operate the device 10 on behalf of the user, while also making it possible for a seated user of average height to reach up and operate the device 10 without the need of assistance from a care-taker, if necessary.

In the embodiment shown in FIGS. 1 and 2, the actuator 16 is affixed to the top of the central member 12 such that the seat 14 moves relative to the actuator 16 and the actuator 16 does not move relative to the central member 12 when the device 10 is in use. However, it will be appreciated that the invention is not limited to the actuator 16 being affixed to the central member 12.

Figure 3:
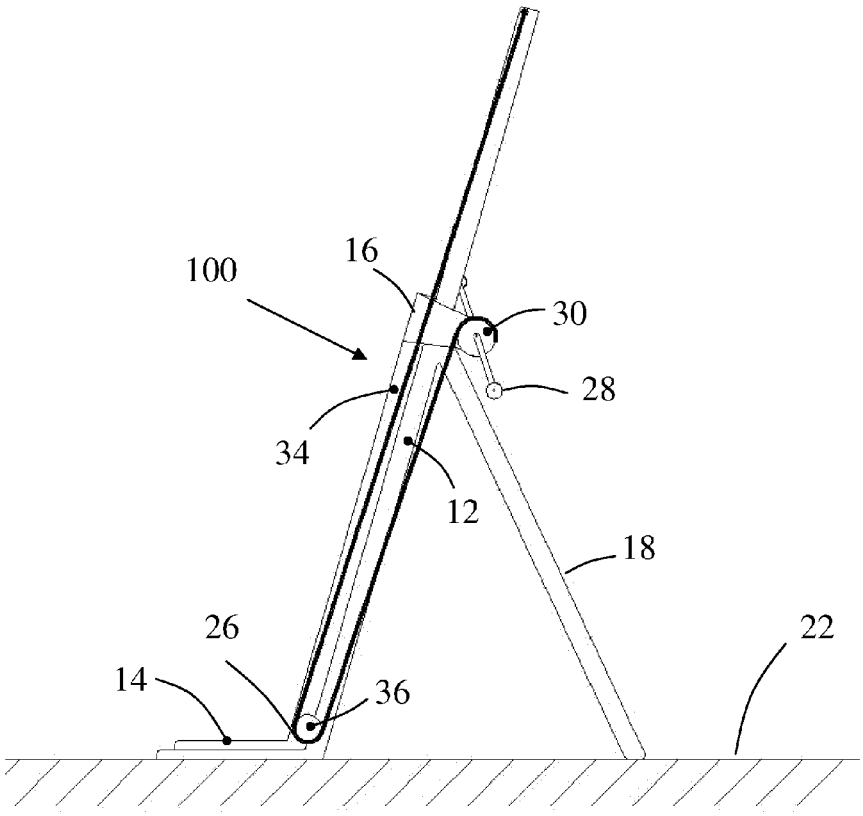
FIG. 3 is a side view of a portable, personal lifting device according to an alternate embodiment when the seat is in a lowered position.
Figure 4:
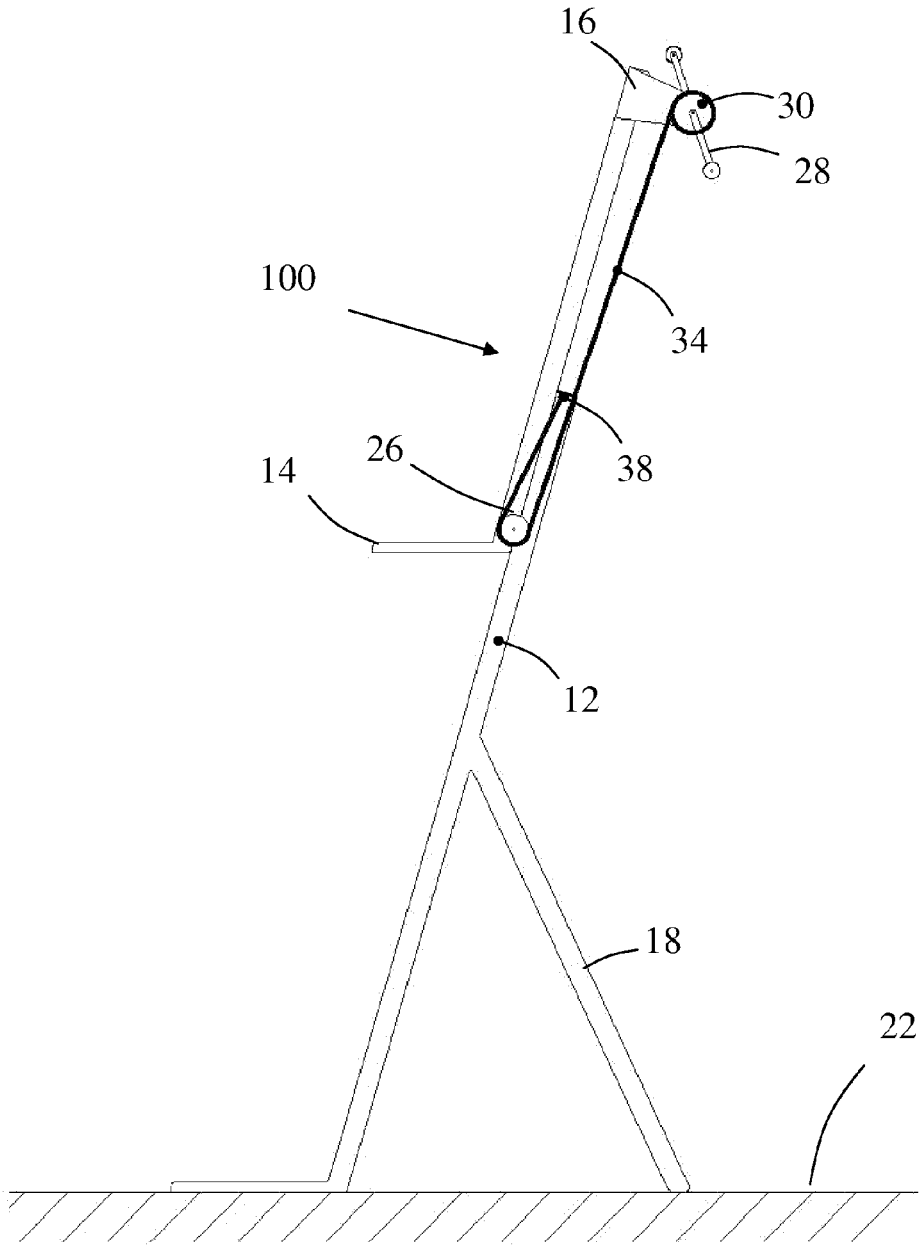
FIG. 4 is a side view of the portable, personal lifting device of FIG. 3 when the seat is in a raised position.

For example, FIGS. 3 and 4 illustrate another embodiment of a personal, portable lifting device 100 in which the actuator 16 moves relative to the central member 12 and the actuator 16 does not relative to the seat 14. In this embodiment, the actuator 16 is affixed to the upper portion of the sliding member 26, rather to the top of the central member 12 as in the embodiment of FIGS. 1 and 2.

In this embodiment, seat 14 is similarly affixed to an intermediate sliding member 26, which is separate and distinct from central member 12, and is able to translate linearly along the central member 12 in a reciprocating fashion. Additionally, actuator 16 is affixed to the upper portion of sliding member 26, and the idler roller 36 is affixed to the lower portion of the central member 12. It will be appreciated that when a cable or strap 34 is affixed to an upper portion 38 of the central member 12, the actuator 16 is able to travel significantly beyond the upper portion 38 of the central member 12.

As shown in FIGS. 3 and 4, it will be observed that intermediate sliding member 26 serves to separate actuator 16 from seat 12, thereby allowing the actuator 16 to be located more conveniently to the user. In one embodiment, the length of intermediate sliding member 26 is approximately equal to the height of the average human torso.

It should be appreciated, however, that there are a number of alternative mechanisms that are capable of translating the rotary motion of the cranks 28 into the linear motion required of the actuator 16, and it should be appreciated that the principles of the invention would remain unchanged were they to be used. Such alternative mechanisms may include, and are not limited to, a rack and pinion, a toothed-belt and timing-pulley, a roller chain and sprocket, a screw and nut, a fluid-power piston and a pump, and the like.

Furthermore, it should be appreciated that a rocking lever, or a pump-arm, may be substituted in place of the cranks 28 without altering the principles of the invention.

Likewise, the devices 10, 100 may be motorized, with the motor being an electric motor, a hydraulic motor, a pneumatic motor, and the like, without altering the principles of the invention.

Use of the Device

Figure 5:
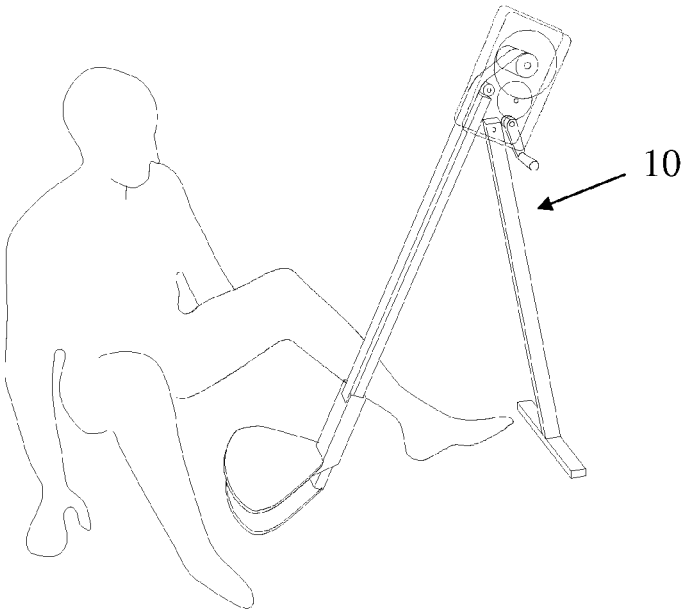
FIG. 5 is a perspective view of the portable, personal lifting device of FIG. 1 in which the user is sitting on the floor proximate the device.
Figure 6:
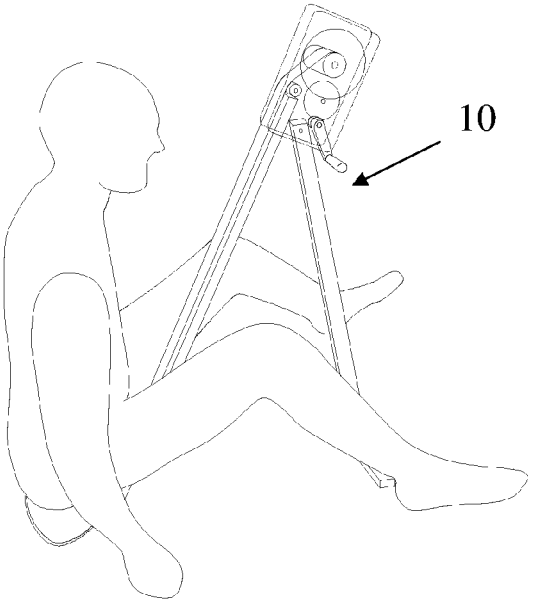
FIG. 6 is a perspective view of the portable, personal lifting device of FIG. 1 in which the user is sitting of the seat of the device while on the floor.

During use, the user approaches the device 10 on the floor from a seated position, as shown in FIG. 5. In this illustrated example, the device 10 is described, but it will be appreciated that the illustrated example applies also to device 100. The user's legs then straddles the device 10, while positioning themselves upon the seat 14, as shown in FIG. 6. Once situated, the user turns the crank 28 in a direction that causes the seat 14 to ascend and move toward the top of the central member 12 until the desired height is attained, as shown in FIG. 7. Once the user has been lifted to the desired height, the user's legs are no longer required to straddle the device 10, as shown in FIG. 8. At this point, the seat 14 is returned to the floor 22, if desired, and the user can step away from the device 10.

Strut Location

In the preferred embodiment FIG. 1, strut 18 comprises an inclined, folding member, which is attached to the central member 10 proximate the top of the central member 12. However, it should be appreciated that the strut 18 may also attach to the approximate midpoint of the central member 12. Furthermore, the strut 18 may take the form of a horizontal member. In addition, the strut 18 may be omitted entirely, and the device may lean against a wall (not shown), if desired. It should be appreciated that these variations in the location of the strut 18 do not affect the principles of the invention.

Angle of Inclination

It has been found that the preferred angle of inclination of the central member 12 with respect to the floor is between about 55 degrees and about 75 degrees, and preferably about 65 degrees. This angle has been found to provide a good compromise between stability and device-length, or 'footprint'. However, it should be appreciated that a greater or lesser angle of inclination are possible, and does not affect the principles of the invention.

Location of Actuator

In the interest of maximizing the stability of the device 10, it is preferable for the user to lean forward slightly during operation. Therefore, it may be preferable to locate the actuator 16 some distance in front of the central member 12. This encourages the user to naturally lean forward while operating the device 10, and also provides a more energy-efficient cranking posture.

Seat Thickness

In practice, it is desirable for the seat 14 to be as thin as possible so that the seat 14 can be easily mounted by the user. Indeed, a useful analogy is found in the action of a spatula, wherein the seat 14 may be easily slid under a passive user with minimal effort by the user.

Seat Profile

It will be appreciated that the seat 14 should permit the user's legs to freely transition from a nearly-horizontal attitude when the seat 14 is positioned near the bottom of the central member 12 to a nearly-vertical attitude when the seat 14 positioned near the top of the central member 12. To facilitate the transition of the user's legs, it is desirable for the seat 14 to have a profile similar to a bicycle seat.

Furthermore, it may be desirable to locate the surface of the seat 5 a predetermined distance away from the central member 12 to allow for adequate clearance between the central member 12 and the user's body. To achieve this clearance, while still providing sufficient structural support to the seat 14, it may be preferable to integrally form the seat 5 with the intermediary sliding member 26 is constructed.

Alternatively, the seat 14 may comprise a base member made from a high yield-strength material such as hardened steel, and the like, to which is attached the seat surface, which may be made of a lighter-weight material, such as aluminum, plastic, and the like. The composite construction permits the seat 14 to support considerable load, while still allowing the seat 14 to be relatively lightweight. It should be appreciated that is also possible to form the seat 14 from a single piece of material, whether the seat 14 incorporates structural ribs for rigidity, or is simply made sufficiently thick to resist the bending moment.

Automatic Descent of Seat

Because the seat 14 is located directly behind the user when standing, it is desirable that the seat 14 return to floor-level before the user steps away from the device 10. One way that the seat 14 can be lowered back to floor is by turning the crank 28 in the opposite direction to raise the seat 14. However, it is possible that the seat 14 can return to the floor automatically, powered either by gravity or by spring force, without requiring the user to operate the cranks 28 in the opposite direction. For the sake of simplicity, it is preferable that the cranks 28 remains engaged to the drive train 32, and are allowed to rotate in reverse as the seat descends. This approach relies on the cranks 28 being clear of the user as they rotate. This condition may be met by locating the actuator 16 sufficiently forward of the user, as previously noted, as well as by employing relatively short crank handles. Additionally, it will also be preferable to provide a damper or governor in the drive train 32 to prevent over-speeding of the cranks 28 while the seat 14 is descending.

As an alternative approach, the seat 14 or actuator 16 may be mechanically disengaged from the drive train 32, thereby allowing seat 14 to return to the floor due to gravitational force.

It should be appreciated that there may exist other methods for removing the seat 14 from the path of the user, including folding the seat—either in half or downward—and rotating the seat 14 vertically so it passes between the legs of the user. These alternative approaches would not alter the principles of the invention.

Use as a Walker

Once the user has gained their footing in the standing position, the device 10 may be employed as a makeshift walker. In practice, the user would push the device 10 ahead of them as they walk. In the preferred embodiment, a pair of fixed handlebars (not shown) can be provided at the top of the device 10 (near the top of the central member 12) to facilitate this use as a walker as well as to provide support for the user as they transition from a seated position to a standing position.

Reversed Seating Position

By reversing the direction that the user faces (i.e., the user faces away from the central member 12), the device 10 can still be used to transfer a person from floor-level to a chair, or from chair-level to a standing position. It will be appreciated that when the user is seated facing away from the device 10, it is possible for the user to step away from the seat without first lowering it back to the floor.

Safety Belt

It may be preferable to provide a safety belt (not shown) or an equivalent restraint to prevent the user from leaning backward and falling off the device 10 during operation of the device 10. In practice, the user would mount the seat 14, pass the belt around their upper back, and then fasten the belt in front of them.

Having described presently preferred embodiments the invention may be otherwise embodied within the scope of the appended claims.

What is claimed is:

1. A portable, personal lifting device, comprising:

a central member having a first end and a second end;

a strut hingedly connected to the first end of the central member to allow the strut to fold against the central member for storage of the device;

a seat attached to the central member in such a way that the seat is capable of translating linearly along the central member;

an actuator for causing translation between the seat and the central member; and a support member attached to the second end of the central member for stabilizing the central member.

2. The device of claim 1, wherein the seat moves relative to the actuator, and wherein the actuator does not move relative to the central member during operation of the device.

3. The device of claim 1, wherein the actuator moves relative to the central member, and wherein the actuator does not move relative to the seat during operation of the device.

4. The device of claim 1, wherein the actuator comprises one or more cranks coupled to a drum through a gear-reduction drive train in such a way that rotation of the drum draws upon a cable or strap, thereby causing the seat to translate linearly along the central member.

5. The device of claim 4, further comprising an idler roller proximate the drum to ensure a constant clearance between the cable or strap and the central member.

6. The device of claim 1, further comprising an intermediate sliding member affixed to the seat.

7. The device of claim 1, wherein the central member is positioned between a user's legs during operation of the device.

* * * * *